US008488998B2

(12) United States Patent
Hayashi et al.

(10) Patent No.: US 8,488,998 B2
(45) Date of Patent: Jul. 16, 2013

(54) DEVELOPING DEVICE AND IMAGE FORMING APPARATUS INCLUDING THE SAME

(75) Inventors: Shigeki Hayashi, Osaka (JP); Takafumi Nagai, Osaka (JP)

(73) Assignee: Sharp Kabushiki Kaisha, Osaka-Shi, Osaka ( * ) Notice: Subject to any disclaimer, the term of this patent is extended or adjusted under 35 U.S.C. 154(b) by 359 days.

(21) Appl. No.: 13/008,308

(22) Filed: Jan. 18, 2011

(65) Prior Publication Data

US 2011/0176836 A1 Jul. 21, 2011

(30) Foreign Application Priority Data

Jan. 18, 2010 (JP) ..... 2010-008197

(51) Int. Cl.
*G03G 15/08* (2006.01)

(52) U.S. Cl.
USPC ..... 399/254

(58) Field of Classification Search
USPC ..... 399/254, 256
See application file for complete search history.

(56) References Cited

U.S. PATENT DOCUMENTS

| | | | | |
|---|---|---|---|---|
| 4,996,565 | A * | 2/1991 | Herley | 399/256 |
| 5,717,973 | A | 2/1998 | Endoh et al. | |
| 5,887,224 | A * | 3/1999 | Mizuishi et al. | 399/256 X |
| 6,324,369 | B1 * | 11/2001 | Yamaguchi et al. | 399/254 |
| 6,615,014 | B2 | 9/2003 | Sugihara | |
| 6,763,214 | B2 * | 7/2004 | Sugihara | 399/254 |
| 7,039,344 | B2 * | 5/2006 | Nishiyama | 399/254 |
| 8,208,837 | B2 * | 6/2012 | Iwamura | 399/254 |
| 8,233,814 | B2 * | 7/2012 | Sheen | 399/254 X |
| 2006/0204283 | A1 * | 9/2006 | Yasuda | 399/254 |

FOREIGN PATENT DOCUMENTS

| | | |
|---|---|---|
| JP | 4-240677 | 8/1992 |
| JP | 05-197283 | 8/1993 |
| JP | 10-142916 | 5/1998 |
| JP | 2002-6598 | 1/2002 |
| JP | 2005-352042 | 12/2005 |
| JP | 2009-098286 | 5/2009 |

* cited by examiner

*Primary Examiner* — Sandra Brase
(74) *Attorney, Agent, or Firm* — Nixon & Vanderhye P.C.

(57) ABSTRACT

A developing device comprising: a developer vessel that accommodates a developer containing a toner and a carrier; a toner supply port; a developing roller; a developer conveying passage; a developer conveying helical member; and a developer scooping member, wherein the developer conveying passage includes a first developer conveying passage and the a second developer conveying passage being defined by a partitioning plate, and a first communicating path and a second communicating path that establish a communication between the first and second developer conveying passage, the developer conveying helical member includes a first developer conveying helical member disposed in the first developer conveying passage, and a second developer conveying helical member disposed in the second developer conveying passage, the developer scooping member includes a first developer scooping member disposed near the first communicating path to send the developer in the first developer conveying passage into the second developer conveying passage, and a second developer scooping member disposed near the second communicating path to send the developer in the second developer conveying passage into the first developer conveying passage.

6 Claims, 8 Drawing Sheets

DEVELOPING DEVICE AND IMAGE FORMING APPARATUS INCLUDING THE SAME

CROSS-REFERENCE TO RELATED APPLICATION

This application is related to Japanese patent application No. 2010-008197 filed on Jan. 18, 2010 whose priority is claimed under 35 USC §119, the disclosure of which is incorporated by reference in its entirety.

BACKGROUND OF THE INVENTION

1. Field of the Invention

The present invention relates to a developing device and an image forming apparatus including the same.

2. Description of the Related Art

In recent years, for electrophotographic image forming apparatuses supporting full-color and high-quality images, a dual-component developer (hereinafter simply referred to as the "developer") which exhibits an excellent charge performance stability as to a toner is in widespread use.

The developer is made up of the toner and a carrier, which are agitated in a developer vessel of a developing device and frictionally rubbed with each other to produce an appropriately electrified toner.

In the developing device, the electrified toner is supplied onto a surface of a developing roller. The toner is moved by an electrostatic attraction from the developing roller to an electrostatic latent image formed on a surface of a photoconductor drum.

Thus, a toner image based on the electrostatic latent image is formed on the photoconductor drum.

Further, there has been an increasing demand for the image forming apparatuses that operate faster and that are miniaturized, which is associated with the necessity to electrify the developer quickly and sufficiently and to convey the developer quickly.

To this end, Prior Art 1 proposes a circulative developing device, which includes first and second developer conveying passages partitioned by a partitioning plate disposed in a developer vessel, first and second communicating paths establishing a communication between the first developer conveying passage and the second developer conveying passage at opposite ends, and first and second auger screws disposed in the first and second developer conveying passages to convey a developer in directions opposite to each other (for example, see Japanese Unexamined Patent Publication No. 2001-255723).

With the developing device, the developer having been conveyed to a downstream point in the first developer conveying passage by the first auger screw is pushed by the developer conveyed from an upstream point in the first developer conveying passage, thereby to be pushed out of the first communicating path into the second developer conveying passage along an interior wall face of the developer vessel. Further, the developer having been conveyed to a downstream point in the second developer conveying passage by the second auger screw is pushed by the developer conveyed from an upstream point in the second developer conveying passage, thereby to be pushed out of the second communicating path into the first developer conveying passage along the interior wall face of the developer vessel. In this manner, the developer circulates through the first developer conveying passage and the second developer conveying passage.

However, with the developing device disclosed in Prior Art 1, because the developer is pressurized at the downstream point in the first developer conveying passage and at the downstream point in the second developer conveying passage, a stress put on the developer becomes great.

When such a stress is put on the developer for a long period, a fluidity improver which is a toner external additive is buried under a surface of the toner. This causes a phenomenon of a reduction in a fluidity of the developer, which eventually makes it difficult for the developer to be conveyed. As a result, the amount of the developer supplied to the photoconductor drum via the developing roller tends to become insufficient, which disadvantageously results in a low-density image printed on a recording medium.

SUMMARY OF THE INVENTION

The present invention has been made in consideration of the foregoing problem, and an object thereof is to provide a developing device that can reduce the stress put on the developer when circulatively conveyed, and an image forming apparatus including the same.

In order to achieve the above object, the present invention provides a developing device to be installed in an electrophotographic image forming apparatus including a photoconductor drum that is to have an electrostatic latent image formed on a surface thereof, the developing device including: a developer vessel that accommodates a developer containing a toner and a carrier; a toner supply port for supplying the toner into the developer vessel; a developing roller that is disposed in the developer vessel and that rotates while carrying the developer to supply the toner onto the surface of the photoconductor drum having the electrostatic latent image formed thereon; a developer conveying passage that is disposed between a position in the developer vessel where the toner is supplied and the developing roller; and a developer conveying helical member and a developer scooping member that are rotatably disposed in the developer conveying passage to convey the developer in the developer conveying passage to the developing roller while agitating the developer, wherein the developer conveying passage includes: a first developer conveying passage associated with the toner supply port and a second developer conveying passage associated with the developing roller, the first developer conveying passage and the second developer conveying passage being defined by a partitioning plate extending in parallel to an axial direction of the developing roller; and a first communicating path and a second communicating path that establish a communication between the first developer conveying passage and the second developer conveying passage at opposite sides in the axial direction, the developer conveying helical member includes a first developer conveying helical member disposed in the first developer conveying passage and a second developer conveying helical member disposed in the second developer conveying passage, the developer scooping member includes a first developer scooping member disposed near the first communicating path to send the developer in the first developer conveying passage into the second developer conveying passage, and a second developer scooping member disposed near the second communicating path to send the developer in the second developer conveying passage into the first developer conveying passage, and the first developer conveying helical member and the second developer conveying helical member convey the developer in directions opposite to each other and the first developer scooping member and the second developer scooping member convey the developer in directions opposite to each other, such that the developer circulates through the first developer conveying passage and the second developer conveying passage.

Further, according to another aspect of the present invention, there is provided an image forming apparatus including: a photoconductor drum that is to have an electrostatic latent image formed on a surface thereof; a charging device that electrifies the surface of the photoconductor drum; an exposure device that forms the electrostatic latent image on the surface of the photoconductor drum; the developing device which supplies a toner to the electrostatic latent image on the surface of the photoconductor drum to form a toner image; a toner supplying device that supplies the toner to the developing device; a transferring device that transfers the toner image on the surface of the photoconductor drum to a recording medium; and a fusing device that fuses the toner image on the recording medium.

With the developing device of the present invention, the developer conveyed to a downstream point in the first developer conveying passage by the first developer conveying helical member is scooped by the first developer scooping member from the first communicating path to the second developer conveying passage. Also, the developer conveyed to a downstream point in the second developer conveying passage by the second developer conveying helical member is scooped by the second developer scooping member from the second communicating path to the first developer conveying passage. Thus, the developer can smoothly circulate through the first developer conveying passage and the second developer conveying passage.

Accordingly, it becomes possible to reduce the stress due to the pressure exerted on the developer at the downstream points in the first and second developer conveying passages, whereby a deterioration of the fluidity of the developer can be prevented.

Further, because the first and second developer conveying helical members can be arranged across the upstream and downstream points in the first and second developer conveying passages, i.e., opposite ends thereof, a retention of the developer at the opposite ends of the first and second developer conveying passages can be prevented.

Still further, with the image forming apparatus including the developing device, because the developer smoothly circulates through the first developer conveying passage and the second developer conveying passage and hence is supplied in a sufficient amount to the photoconductor drum via the developing roller, an image can be printed in a full image density on a recording medium.

DETAILED DESCRIPTION OF THE PREFERRED EMBODIMENTS

Figure 1:
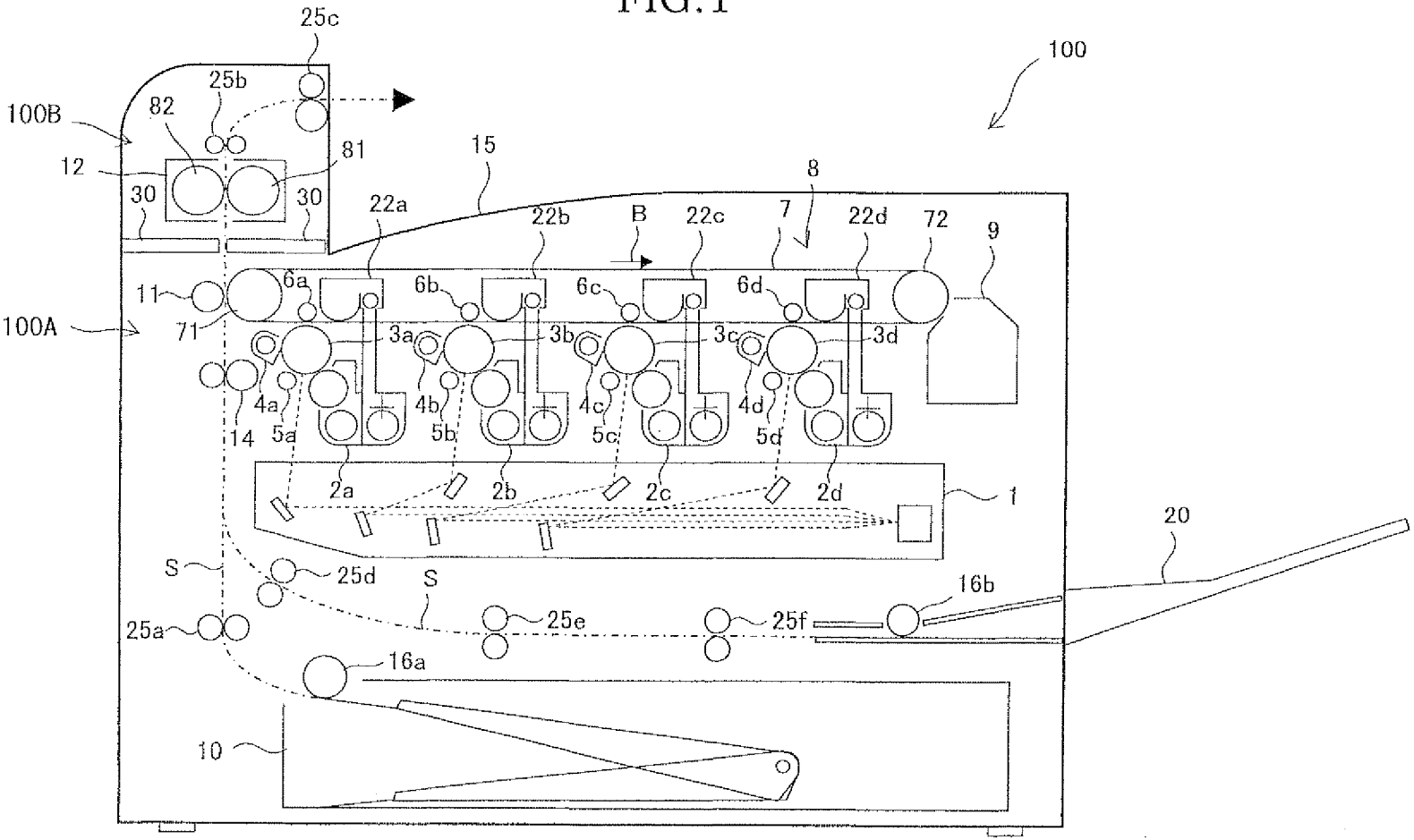
FIG. 1 is an explanatory illustration showing an overall structure of an image forming apparatus including a developing device according to a first embodiment of the present invention.

As described above, the developing device of the present invention includes the developer vessel, the toner supply port, the developing roller, the first and second developer conveying passages, the first and second developer conveying helical members, and the first and second developer scooping members, and is installed in the electrophotographic image forming apparatus such as a monochrome or full-color copier, printer, facsimile machine, or multi function peripheral possessing the functions of the foregoing apparatuses.

The developing device may be structured employing the following modes, which can be used in any combination.

(1) The first developer conveying helical member includes a first rotary shaft rotatably disposed in the first developer conveying passage and a first helical blade fixed to the first rotary shaft. The second developer conveying helical member includes a second rotary shaft rotatably disposed in the second developer conveying passage and a second helical blade fixed to the second rotary shaft. The first developer scooping member includes a third rotary shaft rotatably disposed near the first communicating path and a first scooping blade fixed to the third rotary shaft so as to avoid any contact with the first and second helical blades. The second developer scooping member includes a fourth rotary shaft rotatably disposed near the second communicating path and a second scooping blade fixed to the fourth rotary shaft so as to avoid any contact with the first and second helical blades.

Thus, it becomes possible to manufacture a rotary mechanism that synchronously rotates the first developer conveying helical member and the first developer scooping member and that synchronously rotates the second developer conveying helical member and the second developer scooping member with a simple structure.

(2) The third rotary shaft is disposed in association with the first developer conveying passage, and the fourth rotary shaft is disposed in association with the second developer conveying passage.

Thus, it becomes possible to further reduce the stress put on the developer being sent to the downstream points in the first and second developer conveying passages and to scoop out the developer efficiently to the upstream points in the second and first developer conveying passages.

(3) The developing device further includes a first rotary mechanism that synchronously rotates the first rotary shaft and the third rotary shaft, and a second rotary mechanism that synchronously rotates the second rotary shaft and the fourth rotary shaft. The first scooping blade is made up of a plurality of first scooping plate portions radially disposed about the third rotary shaft. The second scooping blade is made up of a plurality of second scooping plate portions radially disposed about the fourth rotary shaft. The first scooping plate portions are formed so as to extend in an axial direction of the third rotary shaft and have a plurality of clearances or notches for avoiding any contact with the first helical blade when the first and third rotary shafts are synchronously rotated. The second scooping plate portions are formed so as to extend in an axial direction of the fourth rotary shaft and have a plurality of clearances or notches for avoiding any contact with the second helical blade when the second and fourth rotary shafts are synchronously rotated.

Thus, because the first and second scooping blades can be disposed more closely to the first and second helical blades, it becomes possible to further reduce the stress and to efficiently scoop out the developer being sent to the downstream points of the first and second developer conveying passages to the upstream points in the second and first developer conveying passages.

(4) The first rotary mechanism rotates the first rotary shaft and the third rotary shaft at an identical rotation speed, and the second rotary mechanism rotates the second rotary shaft and the fourth rotary shaft at an identical rotation speed. An interval of the plurality of clearances or notches of the first scooping plate portions is identical to a helical interval of the first helical blade, and an interval of the plurality of clearances or notches of the second scooping plate portions is identical to a helical interval of the second helical blade.

Thus, because a width of each of the clearances or notches of the first and second scooping plate portions can be minimized to increase an area in contact with the developer, the developer of near the first and second helical blades can efficiently be scooped out.

(5) A central angle formed between two circumferentially adjacent ones of the first scooping plate portions and a central angle formed between two circumferentially adjacent ones of the second scooping plate portions are each 30 to 90°.

Thus, because the first and second scooping plate portions are disposed on the third and fourth rotary shafts each with an appropriate central angle, it becomes possible to increase an amount of the developer scooped out per revolution of the first and second developer scooping members.

It is to be noted that, when the central angle is less than 30°, it becomes difficult for the developer to enter between the two adjacent ones of the first scooping plate portions or between the two adjacent ones of the second scooping plate portions, resulting in a reduction in the scooped amount of the developer. Conversely, the central angle being greater than 90° reduces the number of times the first and second scooping plate portions scoop out the developer per revolution of the first and second developer scooping members. This results in a reduction in the scooped amount of the developer.

(6) The third rotary shaft of the first developer scooping member is rotated such that a part of the first scooping blade in a downward position relative to the third rotary shaft shifts in a direction identical to a shifting direction of the developer shifting from the first developer conveying passage to the second developer conveying passage. The fourth rotary shaft of the second developer scooping member is rotated such that a part of the second scooping blade in a downward position relative to the fourth rotary shaft shifts in a direction identical to a shifting direction of the developer shifting from the second developer conveying passage to the first developer conveying passage.

Thus, it becomes possible to reduce the pressure generated between the first scooping blade and a bottom face of the developer vessel and the pressure generated between the second scooping blade and the bottom face of the developer vessel. Therefore, it becomes possible to reduce the stress put on the developer even further.

In the following, with reference to the drawings, embodiments of a developing device of the present invention and an image forming apparatus including the same will be described in detail.

First Embodiment

FIG. 1 is an explanatory illustration showing an overall structure of an image forming apparatus including a developing device according to a first embodiment of the present invention.

An image forming apparatus 100 is a printer capable of forming a multi-color or single-color image on a sheet-like recording medium (recording sheet) based on image data externally received, the image forming apparatus 100 including: a developing device housing 100A in which a plurality of developing devices 2*a* to 2*d* are each accommodated in a casing; a fusing device housing 1008 in which a fusing device 12 is accommodated above the developing device housing 100A inside the casing; and a partition wall 30 disposed between the developing device housing 100A and the fusing device housing 100B for insulating the heat generated by the fusing device 12.

A top face of the developing device housing 100A positioned beside the fusing device housing 100B serves as a sheet exit tray 15.

In the present embodiment, the printer is shown as an example of the image forming apparatus. On the other hand, the image forming apparatus can be a copier, a facsimile machine or a multi function peripheral possessing functions of the foregoing apparatuses, that can form a multi-color or single-color image on a recording medium based on image data externally received and/or image data read from an original by use of a scanner.

[Developing Device Housing]

As shown in FIG. 1, the developing device housing 100A chiefly accommodates: four photoconductor drums 3*a*, 3*b*, 3*c*, and 3*d*; four chargers (charging devices) 5*a*, 5*b*, 5*c*, and 5*d* that respectively electrify surfaces of the photoconductor drums 3*a* to 3*d*; an exposure unit (exposure device) 1 that forms an electrostatic latent image on each of the surfaces of the photoconductor drums 3*a* to 3*d*; four developing devices 2*a*, 2*b*, 2*c*, and 2*d* that accommodate corresponding ones of toners of black, cyan, magenta and yellow to develop the electrostatic latent images on the surfaces of corresponding ones of the photoconductor drums 3*a* to 3*d* to thereby form toner images; cleaner units 4*a*, 4*b*, 4*c*, and 4*d* that remove remaining toners on the surface of each of the photoconductor drums 3*a* to 3*d* after development and image transfer operations are carried out; four toner supplying devices 22*a*, 22*b*, 22*c*, and 22*d* that supply corresponding ones of the four-color toners to corresponding ones of the developing devices 2*a* to 2*d*; an intermediate transfer belt unit (transferring device) 8 that transfer the toner images on the surfaces of the photoconductor drums 3*a* to 3*d* to a recording medium; and an intermediate transfer belt cleaner unit 9.

The developing device housing 100A further includes: a sheet feeding tray 10 disposed at a bottommost position in the developing device housing 100A to store a plurality of recording media; a manual sheet feeding tray 20 disposed on one side of the developing device housing 100A such that a recording medium of an arbitrary size is set thereon; and a sheet conveying path S for conveying a recording medium from the sheet feeding tray 10 or the manual sheet feeding tray 20 to an intermediate transfer belt unit (transferring device) 8.

As used herein, as to members denoted by reference character associated with "a" to "d", "a" refers to those members for forming a black image, "b" refers to those members for forming a cyan image, "c" refers to those members for forming a magenta image, and "d" refers to those members for forming a yellow image.

That is, the image forming apparatus 100 is structured such that, based on image data for each of black, cyan, magenta, and yellow color components, a black toner image, a cyan toner image, a magenta toner image and a yellow toner image are selectively formed on the surfaces of the photoconductor drums 3*a* to 3*d*, and the formed toner images are overlaid one over another on the intermediate transfer belt unit 8, so as to form a full-color image on the recording medium.

Because the photoconductor drums 3*a* to 3*d* corresponding to respective colors are of the same structure, the description thereof will collectively be given employing a unified reference character "3". Similarly, the description will collectively be given employing a unified reference character "2" as to the developing devices; a unified reference character "5" as to the chargers; a unified reference character "4" as to the cleaner units; and a unified reference character "22" as to the toner supplying devices.

(Photoconductor Drum and Peripheral Members Thereof)

The photoconductor drum 3 is structured with an electrically conductive base and a photosensitive layer formed on a surface of the base. The photoconductor drum 3 is a cylindrical member that forms a latent image by electrification and exposure. The photoconductor drum 3 exhibits electrical conduction as being illuminated by a light beam, whereby an electrical image called an electrostatic latent image is formed on the surface of the photoconductor drum 3.

The photoconductor drum 3 is supported by not-shown drive means such that it can rotate about its axis.

As the charger 5, a contact roller-type charger, a contact brush-type charger or a non-contact discharging type charger is used, to uniformly electrify the surface of the photoconductor drum 3 to a prescribed potential.

The exposure unit 1 allows a light beam corresponding to image data to pass between the charger 5 and the developing device 2, to illuminate the electrified surface of the photoconductor drum 3 to expose it thereby, such that an electrostatic latent image corresponding to the image data is formed on the surface of the photoconductor drum 3.

In the present embodiment, an exemplary case in which a laser scanning unit (LSU) provided with a laser emitter and reflection mirrors is shown as the exposure unit 1. On the other hand, arrays of light emitting elements such as EL (electroluminescence) or LED writing heads may also be used as the exposure unit 1.

(Developing Device)

Figure 2:
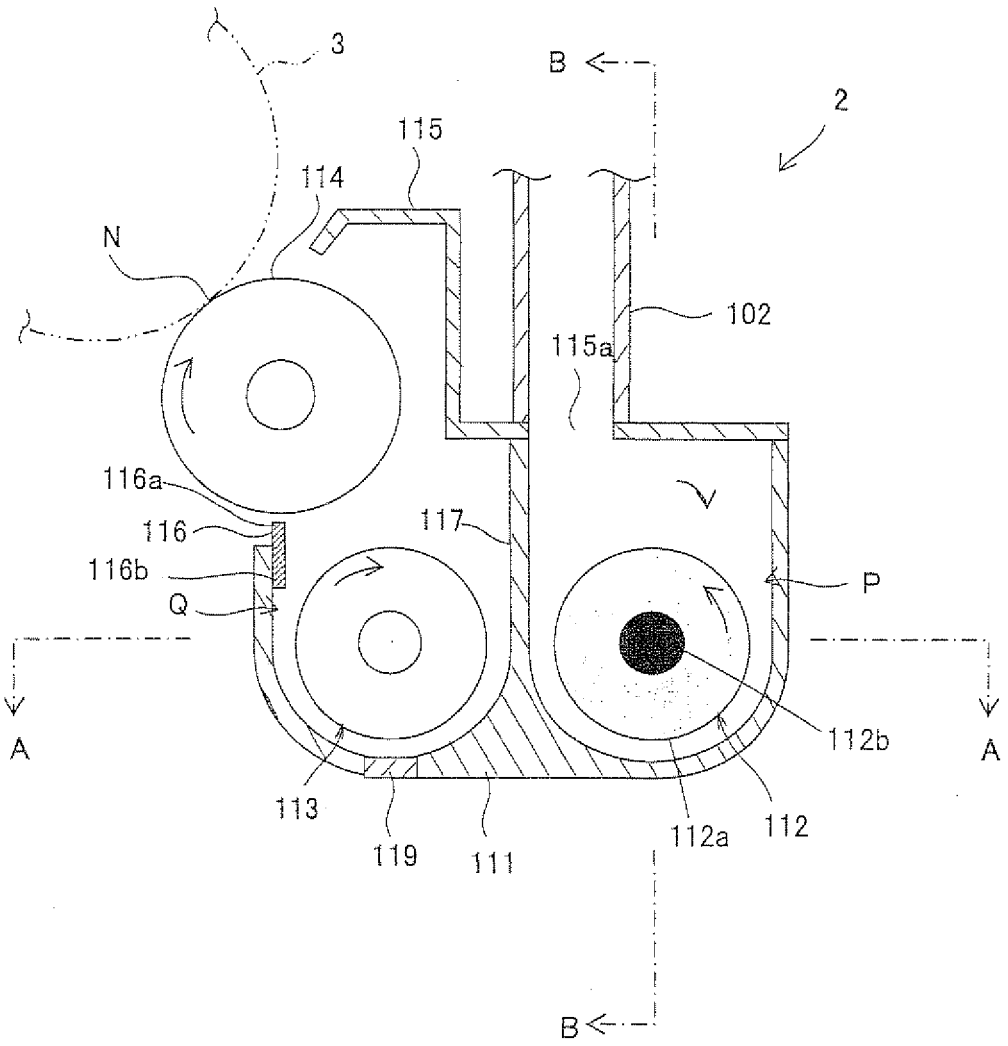
FIG. 2 is a schematic enlarged cross-sectional view of the developing device shown in FIG. 1.
Figure 3:
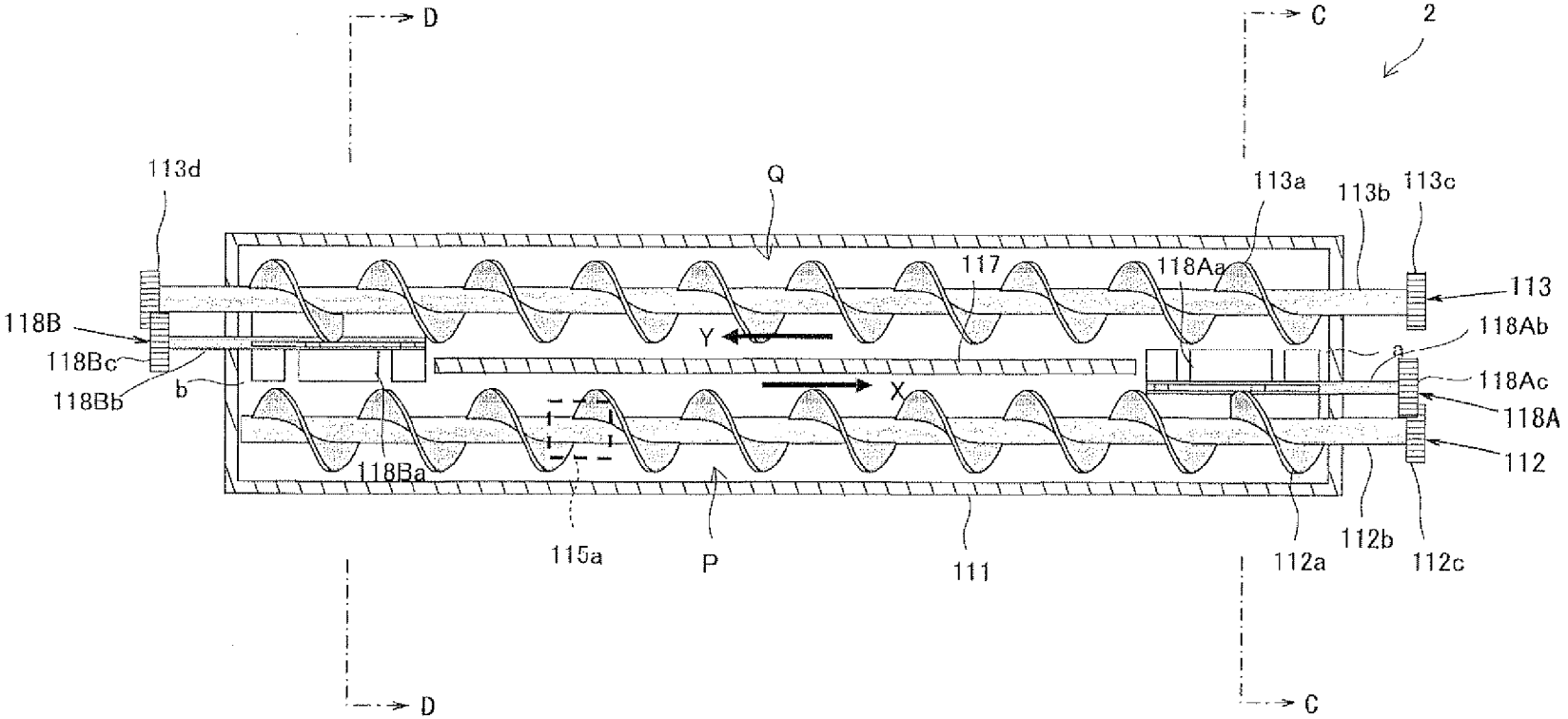
FIG. 3 is a cross-sectional view taken along a line A-A in FIG. 2.
Figure 4:
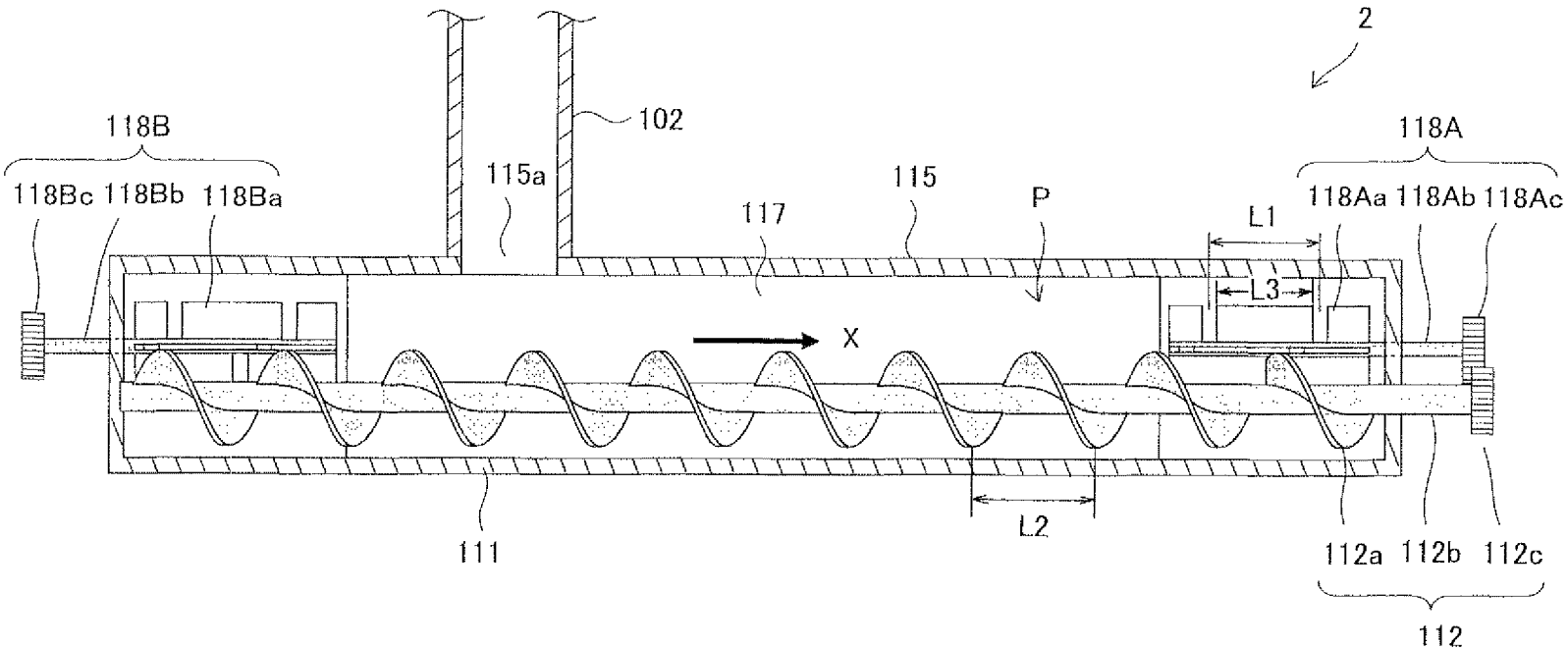
FIG. 4 is a cross-sectional view taken along a line B-B in FIG. 2.
Figure 5:
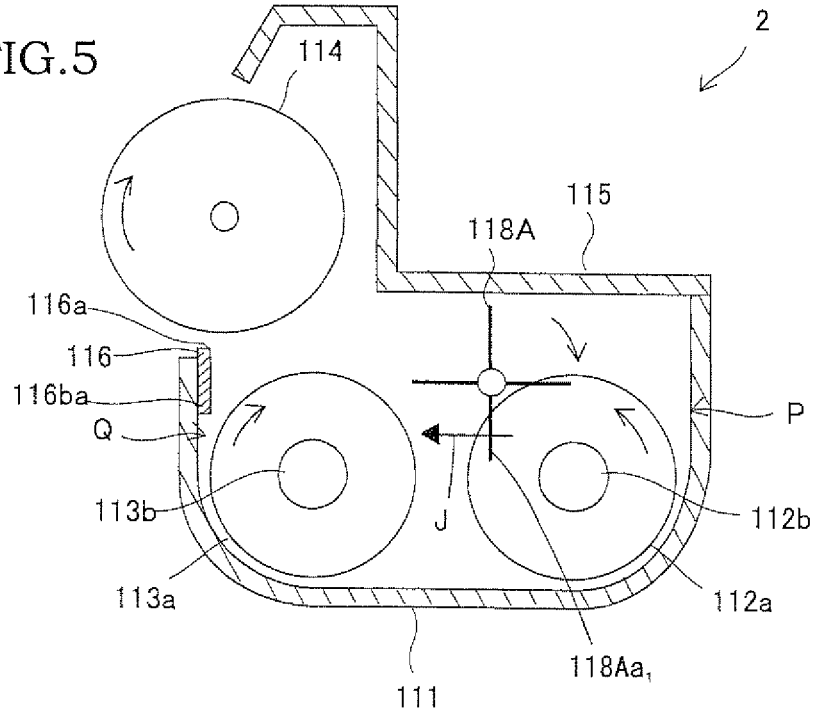
FIG. 5 is a cross-sectional view taken along a line C-C in FIG. 3.
Figure 6:
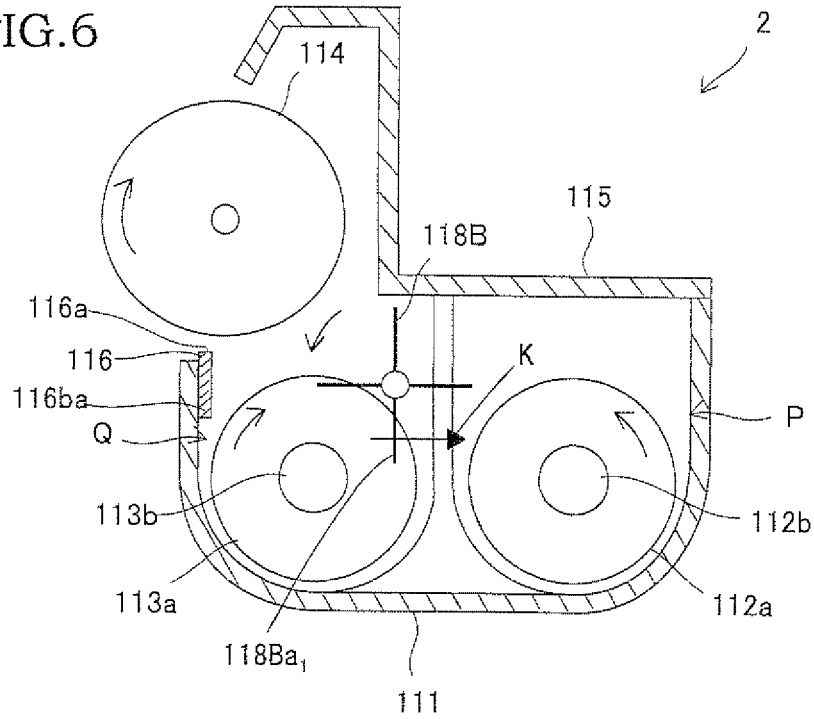
FIG. 6 is a cross-sectional view taken along a line D-D in FIG. 3.

FIG. 2 is a schematic enlarged cross-sectional view of the developing device shown in FIG. 1. FIG. 3 is a cross-sectional view taken along a line A-A in FIG. 2. FIG. 4 is a cross-sectional view taken along a line B-B in FIG. 2. FIG. 5 is a cross-sectional view taken along a line C-C in FIG. 3. FIG. 6 is a cross-sectional view taken along a line D-D in FIG. 3. Throughout these drawings, a developer accommodated in a developer vessel 111 is not shown.

As shown in FIGS. 2 to 6, the developing device 2 includes: the developer vessel 111 being a container in a shape of substantial rectangular parallelepiped for accommodating a developer containing a toner and a carrier; a toner supply port 115*a* for supplying the developer vessel 111 with the toner; a developing roller 114 disposed in the developer vessel 111; first and second developer conveying passages P and Q disposed between a position in the developer vessel 111 where the toner is supplied and the developing roller 114; first and second communicating paths (a) and (b) disposed at opposite ends of the first and second developer conveying passages P and Q to establish a communication between them; first and second developer conveying helical members 112 and 113 rotatably disposed in the first and second developer conveying passages P and Q; a first developer scooping member 118A disposed near the first communicating path (a) to send the developer in the first developer conveying passage P into the second developer conveying passage Q; a second developer scooping member 118E disposed near the second communicating path (b) to send the developer in the second developer conveying passage Q into the first developer conveying passage P; a doctor blade 116; and a toner concentration detecting sensor (permeability sensor) 119. The developing device 2 visualizes (develops) an electrostatic latent image formed on the surface of the photoconductor drum 3 by supplying the toner to the surface of photoconductor drum 3 by use of the developing roller 114.

The developer vessel 111 has its interior partitioned into two chambers by a partitioning plate 117 arranged in parallel to an axial direction of the developing roller 114. One of the two chambers associated with the toner supply port 115*a* is the first developer conveying passage P, and the other associated with the developing roller 114 is the second developer conveying passage Q.

The first developer conveying passage P and the second developer conveying passage Q communicate each other by a first communicating path (a) and a second communicating path (b) at opposite ends in the axial direction.

Thus, the first and second developer conveying passages P and Q and the first and second communicating paths (a) and (b) form one annular developer conveying passage.

The developer vessel 111 further includes a removable developer vessel cover 115 that forms a top wall of the developer vessel 111.

The developer vessel cover 115 is provided with a toner supply port 115*a* upstream in a developer conveying direction (an arrow X direction) in the first developer conveying passage P for the purpose of supplying an unused toner.

The developer vessel 111 has an opening between a sidewall facing the second developer conveying passage Q and a bottom edge of the developer vessel cover 115. At the opening, the developing roller 114 is rotatably disposed so as to form a prescribed developing nip portion N with the photoconductor drum 3.

The developing roller 114 is a magnet roller that is rotated about its axis by not-shown drive means. The developing roller 114 carries the developer in the developer vessel 111 on its surface to supply the toner to the photoconductor drum 3. An application of a developing bias voltage from a not-shown power supply allows the toner to be supplied from the developer on the surface of the developing roller 114 to an electrostatic latent image on the surface of the photoconductor drum 3.

The doctor blade 116 is a rectangular plate-like member extending in parallel to the axial direction of the developing roller 114. A bottom end 116*b* of the doctor blade 116 is fixed to a bottom edge of the opening of the developer vessel 111, while its top end 116*a* is away from the surface of the developing roller 114 by a prescribed gap.

The doctor blade 116 may be made of stainless steel, aluminum, synthetic resin or the like, for example.

<First and Second Developer Conveying Helical Members>

The first developer conveying helical member (which may be referred to as the "first helical member") 112 is structured with a first rotary shaft 112*b* disposed rotatably in the first developer conveying passage P and in parallel thereto, a helical blade (auger screw) 112*a* fixed to an outer circumferential surface of the first rotary shaft 112*b*, and a first gear 112*c* disposed at one end of the first rotary shaft 112*b*.

One end of the first rotary shaft 112*b* penetrates through one sidewall of the developer vessel 111 in terms of the longitudinal direction, to project outside the developer vessel 111, where a first gear 112*c* is fixed to the one end.

The second developer conveying helical member (which may be referred to also as the "second helical member" hereinafter) 113 is structured with a second rotary shaft 113*b* disposed rotatably in the second developer conveying passage Q and in parallel thereto, a helical blade (auger screw) 113*a* fixed to an outer circumferential surface of the second rotary shaft 113*b*, and second gears 113*c* and 113*d* respectively disposed at opposite ends of the second rotary shaft 113*b*.

In this case, the helical blade 112*a* of the first helical member 112 and the helical blade 113*a* of the second helical member 113 are the same in a helical twist direction.

The first gear 112*c* of the first helical member 112 meshes with a first drive gear of not-shown drive means (e.g., a motor), and the second gear 113*c* of the second helical member 113 meshes with a second drive gear of the drive means. As the first drive gear and the second drive gear rotate reversely relative to each other, the first gear 112*c* and the third gear 113*c* rotate reversely relative to each other.

Accordingly, the helical blade 112*a* of the first helical member 112 and the helical blade 113*a* of the second helical member 113 rotate reversely relative to each other. Therefore, as shown in FIG. 3, the developer in the first developer conveying passage P is conveyed in an arrow X direction while being agitated in the rotation direction, and the developer in the second developer conveying passage Q is conveyed in an arrow Y direction while being agitated in the rotation direction.

It is to be noted that, the developing device 2 may alternatively be structured having the first and second gears 112*c* and 113*c* meshed with each other, and having one of them meshed with one drive gear to rotate, so as to allow the first helical member 112 and the second helical member 113 to rotate reversely relative to each other, because such a structure similarly allows the developer to circulate in opposite directions between the first developer conveying passage P and the second developer conveying passage Q.

Alternatively, the developing device 2 may be structured employing the helical blade 112*a* of the first helical member 112 and the helical blade 113*a* of the second helical member 113 each having the helical twist direction reverse to the other's, and having the first and second gears 112*c* and 113*c* meshed with an identical drive gear to rotate in the same direction, because such a structure similarly allows the developer to circulate in the opposite directions between the first developer conveying passage P and the second developer conveying passage Q.

<First Developer Scooping Member>

Figure 7:
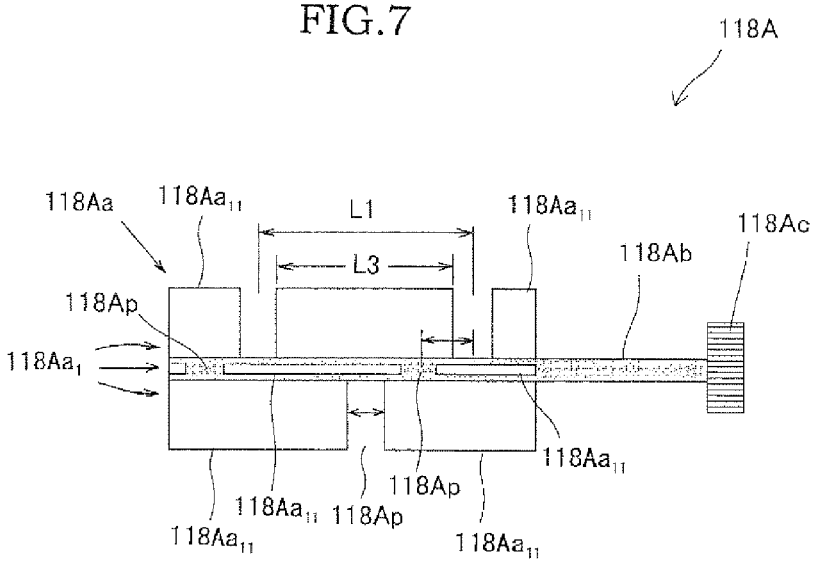
FIG. 7 is a front view showing a first developer scooping member in the developing device according to the first embodiment.

FIG. 7 is a front view showing the first developer scooping member in the developing device according to the first embodiment.

As shown in FIGS. 3 to 7, the first developer scooping member 118A is structured with: a third rotary shaft 118Ab rotatably disposed diagonally above the first rotary shaft 112*b* and in parallel thereto, and in association with the first developer conveying passage P near the first communicating path (a); a first scooping blade 118Aa fixed to the third rotary shaft 118Ab; and a third gear 118Ac disposed at one end of the third rotary shaft 118Ab.

The third rotary shaft 118Ab is rotatably supported at one sidewall in terms of the longitudinal direction of the developer vessel 111 so as to be disposed diagonally above and near the first rotary shaft 112*b*, having its one end penetrate through the one sidewall of the developer vessel 111 in terms of the longitudinal direction.

In this case, a length of a portion of the third rotary shaft 118Ab projecting inside the developer vessel 111 is shorter than an opening width of the first communicating path (a).

The third gear 118Ac is fixed to the one end of the third rotary shaft 118Ab projecting outside the developer vessel 111.

The third gear 118Ac meshes with the first gear 112*c* of the first helical member 112, and rotates reversely to and in synchronization with the first gear 112*c*.

More specifically, the first gear 112*c* and the third gear 118Ac are each structured by a gear identical to the other's, and rotate at the same rotation speed.

That is, the first gear 112*c* and the third gear 118Ac structure a rotary mechanism that rotates the first rotary shaft 112*b* and the third rotary shaft 118Ab at the same rotation speed in synchronization with each other.

The first scooping blade 118Aa is structured with a plurality of first scooping plate portion sets 118$Aa_1$ radially disposed about the third rotary shaft 118Ab. In the present embodiment, a central angle formed between two adjacent ones of the first scooping plate portions 118$Aa_1$ of the first scooping blade 118Aa is 90°. That is, four first scooping plate portion sets 118$Aa_1$ are provided, each forming the central angle of 90° between adjacent one of the first scooping plate portion sets 118$Aa_1$.

The first scooping plate portions 118$Aa_1$ extend in the axial direction of the third rotary shaft 118Ab, each provided with a plurality of clearances 118Ap for avoiding any contact with the helical blade 112*a* when the first and third rotary shaft 112*b* and 118Ab synchronously rotate.

In more detail, one first scooping plate portion set 118$Aa_1$ is made up of a plurality of rectangular plate pieces 118$Aa_{11}$ attached along the third rotary shaft 118Ab having the clearances 118Ap. An interval L1 of two adjacent ones of the clearances 118Ap is just as great as a helical interval L2 of the helical blade 112*a* of the first helical member 112, while a length L3 of the plate piece 118$Aa_{11}$ is set shorter than the helical interval L2.

In order to avoid any contact with the helical blade 112*a* of the first helical member 112 that synchronously rotates, two adjacent ones of the first scooping plate portion sets 118$Aa_1$ adjacent to each other by the central angle of 90° are disposed on the third rotary shaft 118Ab such that an interval $L_{11}$ which is an axial displacement amount of the clearances 118Ap of the two adjacent first scooping plate portion sets 118$Aa_{11}$ becomes one-fourth as short as the interval L1.

It goes without saying that a width W of each clearance 118Ap and the length L3 of each plate piece 118$Aa_{11}$ are set so as to avoid any contact with the rotating helical blade 112*a* of the first helical member 112.

Because the first developer scooping member 118A rotates in synchronization with the first helical member 112 at the same rotation speed, the developer near the first rotary shaft 112*b* can be sent from the first communicating path (a) into the second developer conveying passage Q while avoiding any contact with the helical blade 112*a* of the first helical member 112.

In this case, as shown in FIG. 5, the third rotary shaft 118Ab of the first developer scooping member 118A rotates such that a part of the first scooping blade 118Aa positioned below the third rotary shaft 118Ab shifts in the same direction as a shifting direction (arrow J direction) of the developer which is shifting from the first developer conveying passage P to the second developer conveying passage Q.

Thus, it becomes possible to reduce the pressure generated between the first scooping blade 118Aa and the bottom face of the developer vessel 111, and to reduce the stress put on the developer.

It is to be noted that the rotation speed of the first developer scooping member 118A may be faster or slower than that of the first helical member 112. In such cases, in order to avoid any contact between the first developer scooping member 118A and the first helical member 112, the interval (displacement dimension) $L_{11}$ and the width W of each of the clearances 118Ap of the first scooping plate portion sets 118$Aa_1$ should be adjusted in accordance with a ratio between the rotation speed of the first developer scooping member 118A and that of the first helical member 112.

<Second Developer Scooping Member>

The second developer scooping member 118B is an identically structured component as the first developer scooping member 118A shown in FIG. 7, and is structure with a fourth rotary shaft 118Bb, a second scooping blade 118Ba fixed to the fourth rotary shaft 118Bb, and a fourth gear 118Bc disposed at one end of the fourth rotary shaft 118Bb.

That is, the second scooping blade 118Ba is made up of four second scooping plate portion sets 118$Ba_1$ radially disposed about the fourth rotary shaft 118Bb, each forming a central angle of 90° between adjacent one of the second scooping plate portion sets 118$Ba_1$.

The second scooping plate portions 118$Ba_1$ extend in the axial direction of the fourth rotary shaft 118Bb, each provided with a plurality of clearances for avoiding any contact with the helical blade 113*a* when the second and fourth rotary shafts 113*b* and 118Bb synchronously rotate.

The fourth rotary shaft 118Bb is rotatably disposed diagonally above the second rotary shaft 113*b* and in parallel thereto, and in association with the second developer conveying passage Q near the second communicating path (b).

The fourth rotary shaft 118Bb is rotatably supported at other sidewall in terms of the longitudinal direction of the developer vessel 111 so as to be disposed diagonally above and near the second rotary shaft 113*b*, having its one end penetrate through the other sidewall in terms of the longitudinal direction of the developer vessel 111.

In this case, a length of a portion of the fourth rotary shaft 118Bb projecting inside the developer vessel 111 is shorter than an opening width of the second communicating path (b).

The fourth gear 118Bc meshes with the second gear 113*d* of the second helical member 113, and rotates reversely to and in synchronization with the second gear 113*d*.

In more detail, the second gear 113*d* and the fourth gear 118Bc are each structured by a gear identical to the other's, and rotate at the same rotation speed.

That is, the second gear 113*d* and the fourth gear 118Bc structure a rotary mechanism that rotates the second rotary shaft 113*b* and the fourth rotary shaft 118Bb at the same rotation speed in synchronization with each other.

Because the second developer scooping member 118B rotates in synchronization with the second helical member 113 at the same rotation speed, the developer near the second rotary shaft 113*b* can be sent from the second communicating path (b) into the first developer conveying passage P while avoiding any contact with the helical blade 113*a* of the second helical member 113.

In this case, as shown in FIG. 6, the fourth rotary shaft 118Bb of the second developer scooping member 118B rotates such that a part of the second scooping blade 118Ba positioned below the fourth rotary shaft 118Bb shifts in the same direction as a shifting direction (arrow K direction) of the developer which is shifting from the second developer conveying passage Q to the first developer conveying passage P.

Thus, it becomes possible to reduce the pressure generated between the second scooping blade 118Ba and the bottom face of the developer vessel 111, and to reduce the stress put on the developer.

It is to be noted that the rotation speed of the second developer scooping member 118B may be faster or slower than that of the second helical member 113. In such cases, similarly to the first developer scooping member 118A, in order to avoid any contact between the second developer scooping member 118B and the second helical member 113, the interval (displacement dimension) and the width of each of the clearances of the second scooping plate portion sets 118$Ba_1$ should be adjusted in accordance with a ratio between the rotation speed of the second developer scooping member 118B and that of the second helical member 113.

A toner concentration detecting sensor 119 is mounted at a substantially central portion of the second developer conveying passage Q at a bottom face of the developer vessel 111 right below the second helical member 113, having its sensor face exposed inside the second developer conveying passage Q.

The toner concentration detecting sensor 119 is electrically connected to not-shown toner concentration control means.

The toner concentration control means exerts control in accordance with a toner concentration measurement value detected by the toner concentration detecting sensor 119, so as to rotate a toner discharging member 122 of a toner supplying device 22 (see FIG. 8), whose description will be given later, and to discharge the toner from a toner discharge port 123 to be supplied to the first developer conveying passage P of the developing device 2.

When the toner concentration control means determines that the toner concentration measurement value is lower than a toner concentration set value, a control signal is transmitted to drive means that rotates the toner discharging member 122, whereby the toner discharging member 122 rotates.

The toner concentration detecting sensor 119 may be a general toner concentration detecting sensor, such as a transmitted light detecting sensor, a reflected light detecting sensor, a permeability detecting sensor or the like. Of these, the permeability detecting sensor is preferable.

A not-shown power supply is connected to the permeability detecting sensor (toner concentration detecting sensor 119).

The power supply applies, to the permeability detecting sensor, a drive voltage for driving the permeability detecting sensor and a control voltage as an output of a detection result of the toner concentration to the control means.

The application of the voltages to the permeability detecting sensor by the power supply is controlled by the control means.

The permeability detecting sensor is of a type that receives the control voltage and outputs the detection result of the toner concentration as an output voltage value. Basically, the sensor exhibits an excellent sensitivity about the output center voltage value, and hence a control voltage capable of providing the output voltage around such a value is applied when used.

The permeability detecting sensor of such a type is commercially available. Examples thereof include those marketed under trade names TS-L, TS-A, and TS-K by TDK Corporation.

(Toner Supplying Device)

Figure 8:
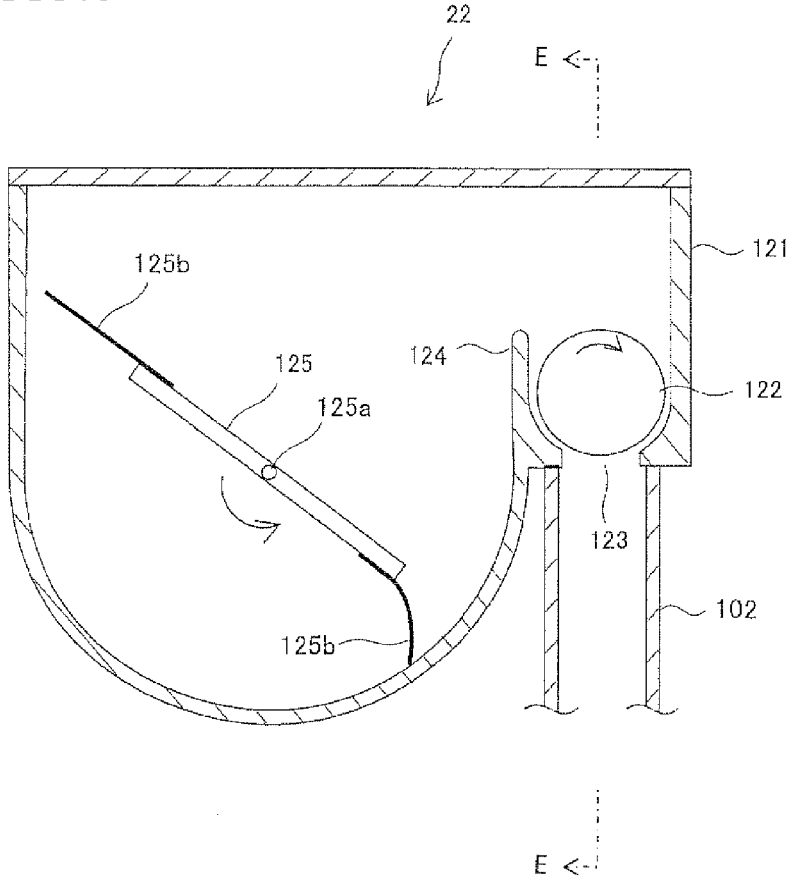
FIG. 8 is a schematic cross-sectional view showing a toner supplying device in the developing device according to the first embodiment.
Figure 9:
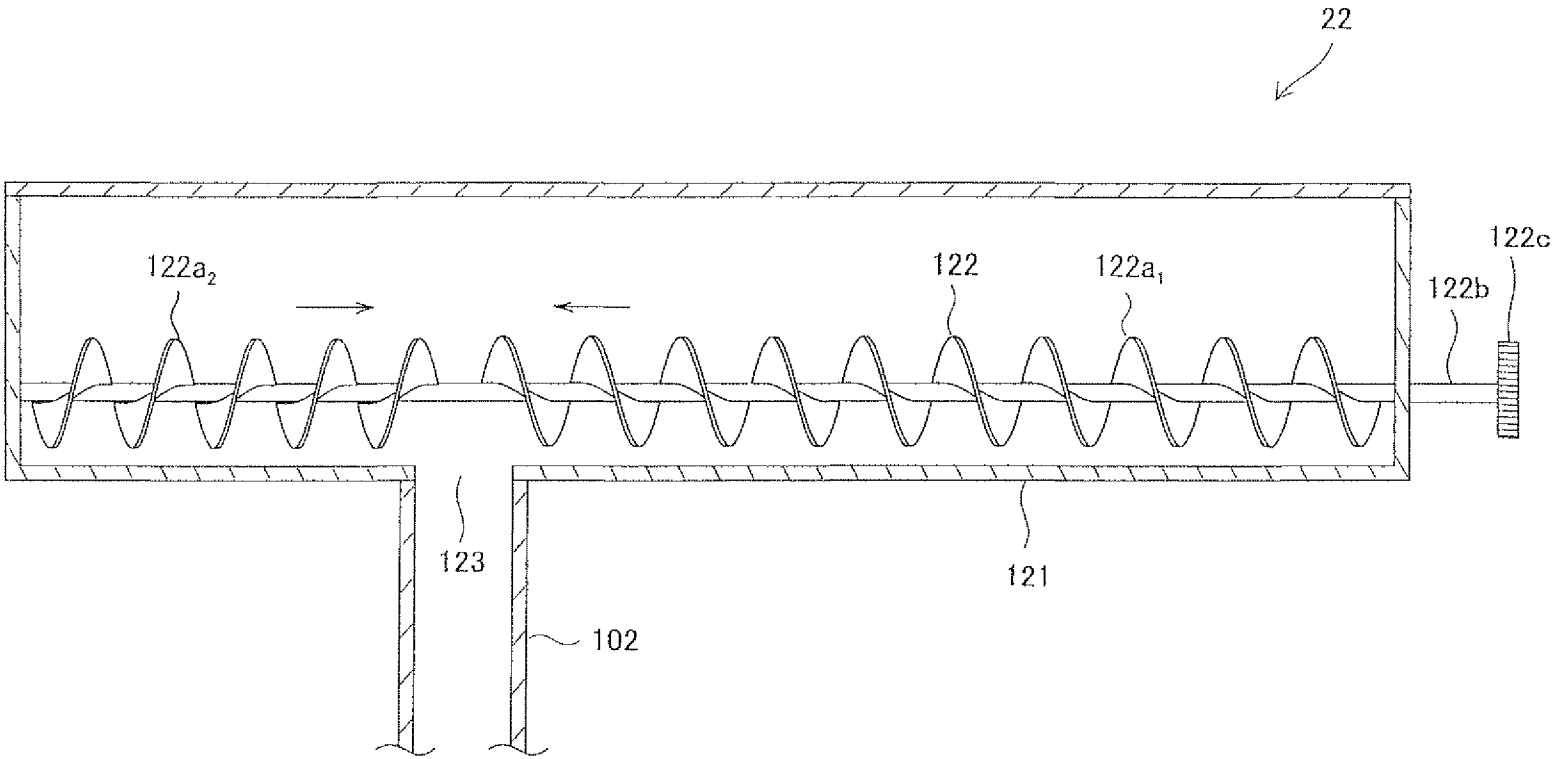
FIG. 9 is a cross-sectional view taken along a line E-E in FIG. 8.

FIG. 8 is a schematic cross-sectional view showing the toner supplying device in the developing device according to the first embodiment. FIG. 9 is a cross-sectional view taken along a line E-E in FIG. 8.

As shown in FIGS. 8 and 9, the toner supplying device 22 includes a toner container 121 having the toner discharge port 123, a toner agitating member 125, and the toner discharging member 122, and accommodates unused toner therein.

The toner supplying device 22 is disposed above the developer vessel 111 (see FIG. 1), having its toner discharge port 123 connected to the toner supply port 115*a* (see FIG. 2) of the developing device 2 by a toner conveying pipe 102.

The toner container 121 is a hollow substantially semicylindrical container. The toner discharge port 123 is disposed beside the circumference of the semicylindrical part.

The toner agitating member 125 is rotatably disposed at a substantially central position of the semicylindrical part of the toner container 121, and the toner discharging member 122 is rotatably disposed at a position above and near the toner discharge port 123.

The toner agitating member 125 is a plate-like member that rotates about a rotary shaft 125*a*, and has a sheet-like toner draw-up member 125*b* made of an elastic resin (e.g., polyethylene terephthalate) at each opposite tip away from the rotary shaft 125*a*. In this case, the rotary shaft 125*a* is rotatably supported at opposite sidewalls of the toner container 121 in terms of the longitudinal direction. One end of the rotary shaft 125*a* penetrates through the sidewall. A gear meshing with a drive gear of not-shown drive means is fixed to the one end.

As the toner draw-up member 125*b* of the toner agitating member 125 rotates from the bottom toward the top relative to the toner discharge port 123, the toner accommodated in the toner container 121 is drawn up while being agitated, and conveyed to the toner discharging member 122.

In this case, the elasticity of the toner draw-up member 125*b* allows the toner draw-up member 125*b* to slidably rotate as being deformed along the interior wall of the toner container 121, to thereby supply the toner toward the toner discharging member 122.

It is to be noted that a toner discharging member partition wall 124 is provided between the toner discharging member 122 and the toner agitating member 125, such that the toner drawn up by the toner agitating member 125 can be retained by an appropriate amount around the toner discharging member 122.

The toner discharging member 122 is structured with a rotary shaft 122*b* having its opposite ends rotatably supported at opposite sidewalls of the toner container 121 in terms of the longitudinal direction, first and second helical blades $\mathbf{122}a_1$ and $\mathbf{122}a_2$ fixed to an outer circumferential surface of the rotary shaft 122*b*, and a gear 122*c* fixed to one end of the rotary shaft 122*b* penetrating through the sidewall of the toner container 121.

The gear 122*c* meshes with a drive gear of not-shown drive means.

The helical twist direction of the first helical blade $\mathbf{122}a_1$ is reverse relative to that of the second helical blade $\mathbf{122}a_2$. The toner discharge port 123 is arranged between the first helical blade $\mathbf{122}a_1$ and the second helical blade $\mathbf{122}a_2$.

A rotation of the toner discharging member 122 allows the toner supplied around the toner discharging member 122 to be conveyed by the first helical blade $\mathbf{122}a_1$ and the second helical blade $\mathbf{122}a_2$ from axial opposite ends of the toner discharging member 122 toward the toner discharge port 123, and to be supplied from the toner discharge port 123 into the developer vessel 111 via the toner conveying pipe 102.

<Operation of Developing Device>

In a developing step with the image for min apparatus, as shown in FIGS. 3 to 6, the developing roller 114, the first and second helical members 112 and 113 and the first and second developer scooping members 118A and 118B of the developing device 2 rotate in directions indicated by arrows, respectively.

In this case, the developer in the first developer conveying passage P is conveyed in the arrow X direction (see FIGS. 3 and 4) while being agitated by the first helical member 112 in its rotational circumferential direction, to be sent to the first developer scooping member 118A downstream therefrom, and the developer in the second developer conveying passage Q is conveyed in the arrow Y direction (see FIG. 3) while being agitated by the second helical member 113 in its rotational circumferential direction, to be sent to the second developer scooping member 118B downstream therefrom.

At the same time, the developer on a downstream side in the first developer conveying passage P is scooped at a right angle relative to the arrow X direction by the first developer scooping member 118A, to smoothly be sent to the second developer conveying passage Q. The developer on a downstream side in the second developer conveying passage Q is scooped at the right angle relative to the arrow Y direction by the second developer scooping member 118B, to smoothly be sent to the first developer conveying passage P.

In this manner, the developer in the developer vessel 111 circulates through the first developer conveying passage P and the second developer conveying passage Q, and the toner of the developer is sufficiently electrified by the friction between itself and the carrier.

The developer shifting in the second developer conveying passage Q is partially supplied to the developing roller 114.

The developer supplied to the developing roller 114 is sent to the photoconductor drum 3 (see FIG. 2) by the doctor blade 116 in a form of a uniform developer layer having a prescribed thickness on the outer circumferential surface of the developing roller 114. From the developer layer, the toner is partially supplied to the photoconductor drum 3. Thereafter, the developer whose toner concentration is lowered on the developing roller 114 is blended with the developer in the second developer conveying passage Q.

Accordingly, the toner concentration of the developer in the second developer conveying passage Q gradually becomes low.

Because the toner concentration of the developer in the second developer conveying passage Q is detected by the toner concentration detecting sensor 119, when the toner concentration becomes smaller than a prescribed value, the unused toner is supplied from the toner supplying device 22 onto the developer (existing developer) in the first developer conveying passage P. Then, by the rotation of the first helical member 112, the supplied toner is blended and dispersed into the existing developer.

(Intermediate Transfer Belt Unit and Intermediate Transfer Belt Cleaner Unit)

As shown in FIG. 1, the intermediate transfer belt unit 8 disposed above the photoconductor drums 3 includes an intermediate transfer belt 7, intermediate transfer rollers 6*a*, 6*b*, 6C, and 6*d* (hereinafter, the description will collectively be given employing a unified reference character "6") for suspending the intermediate transfer belt 7 in a tense state to rotate the same in an arrow B direction in FIG. 1, a drive roller 71, a driven roller 72 and a belt tensioning mechanism (not-shown), and a transfer roller 11 disposed beside and in proximity to the drive roller 71. It is to be noted that the intermediate transfer rollers 6 are each rotatably supported by a roller mounting portion of the belt tensioning mechanism.

Further, the intermediate transfer belt cleaner unit 9 is disposed next to the driven roller 72 of the intermediate transfer belt unit 8.

The drive roller 71 and the driven roller 72 are disposed externally to the outmost photoconductor drums 3, respectively, out of the four photoconductor drums 3, so that the intermediate transfer belt 7 is brought into contact with the photoconductor drums 3.

The intermediate transfer belt 7 is formed in an endless manner using a film having a thickness of about 100 to 150 μm, for example. The toner images of different color components formed on respective photoconductor drums 3 are successively transferred one over another on the external face of the intermediate transfer belt 7, to form a full-color toner image (multi-color toner image).

A transfer operation of the toner image from the photoconductor drums 3 to the intermediate transfer belt 7 is carried out by the intermediate transfer rollers 6 which are in contact with an internal face of the intermediate transfer belt 7.

Each intermediate transfer roller 6 is made up of a metal shaft (e.g., made of stainless steel) having a diameter of, e.g., 8 to 10 mm, and a conductive elastic material layer coating the outer circumferential surface of the metal shaft.

Examples of the conductive elastic material layer include ethylene propylene diene terpolymer (EPDM), foamed urethane or the like that contains a conductive material such as carbon black.

A high-voltage transfer bias (a high voltage whose polarity is opposite (+) to a polarity (−) of the electrostatic charge on the toner) is applied to the metal shaft of each of the intermediate transfer rollers 6 for transferring the toner images, whereby the intermediate transfer rollers 6 can uniformly apply a high voltage to the intermediate transfer belt 7.

While intermediate transfer rollers 6 are used as transfer electrodes in the present embodiment, brushes or the like can be used instead.

The toner image overlaid on the external surface of the intermediate transfer belt 7 shifts to a position of the transfer roller 11 (transfer portion) by the rotation of the intermediate transfer belt 7.

On the other hand, a recording medium is also conveyed through the sheet conveying path S to the transfer portion, where the recording medium is pressed against the intermediate transfer belt 7 by the transfer roller 11. Thus, the toner image on the intermediate transfer belt 7 is transferred onto the recording medium.

In this case, the intermediate transfer belt 7 and the transfer roller 11 are pressed against each other at a prescribed nip, while a high voltage is applied to the transfer roller 11 for transferring the toner image onto the recording medium. In this case, a polarity of the high voltage is opposite (+) to the polarity (−) of the electrostatic charge on the toner.

Further, in order to constantly obtain the nip between the intermediate transfer belt 7 and the transfer roller 11, one of the transfer roller 11 and the drive roller 71 is formed of a hard material such as metal, and the other is formed of a soft material such as rubber, foamed resin or the like.

The toner having not been transferred from the intermediate transfer belt 7 to the recording medium and remaining on the intermediate transfer belt 7 may cause undesired blend of toners of different colors when overlaying a new toner image on the intermediate transfer belt 7, and hence the remaining toner is removed and collected by the intermediate transfer belt cleaner unit 9.

The intermediate transfer belt cleaner unit 9 includes a cleaning blade in contact with the intermediate transfer belt 7 to remove the remaining toner, and a toner collector that collects the removed toner.

It is noted that a portion in the intermediate transfer belt 7 which is brought into contact with the cleaning blade is supported by the driven roller 72.

(Sheet Conveying Path and Peripheral Member Thereof)

As shown in FIG. 1, the sheet conveying path S extends from the sheet feeding tray 10 and the manual sheet feeding tray 20, passing through the fusing device 12 whose description will be given later, to reach the sheet exit tray 15. Along the sheet conveying path S, pickup rollers 16*a* and 16*b*, feed rollers 25*a* to 25*h* (hereinafter, the description will collectively be given employing a unified reference character "25"), a registration roller 14, the transfer roller 11, the fusing device 12 and the like are disposed.

The feed rollers 25 are small rollers for facilitating and assisting sheet conveyance, and paired along the sheet conveying path S.

The pickup roller 16*a* is disposed at an end portion of the sheet feeding tray 10, to pick up sheet-like recording media (recording sheets) one by one from the feed tray 10 and supplies it to the sheet conveying path S.

The pickup roller 16*b* is disposed near the manual sheet feeding tray 20, to pick up the recording media one by one from the manual sheet feeding tray 20 and supplies it to the sheet conveying path S.

The registration roller 14 temporarily holds the recording medium conveyed on the sheet conveying path S, and delivers the recording medium to the transfer portion at a timing intended to align a tip of the toner image on the intermediate transfer belt 7 with a tip of the recording medium.

[Fusing Device Housing]

As shown in FIG. 1, the fusing device 12 accommodated in the fusing device housing 100B includes a heat roller 81 and a pressure roller 82 that rotate in directions opposite to each other while clamping the recording medium carrying the transferred toner image thereon, a feed roller 25*b*, and a sheet exit roller 25*c*.

The heat roller 81 is controlled by a not-shown controller such that it reaches a prescribed fusing temperature. The controller controls the temperature of the heat roller 81 based on a detection signal received from a not-shown temperature detector.

The heat roller 81 having reached the fusing temperature and the pressure roller 82 press against the recording medium to melt the toner, whereby the toner image is fused on the recording medium.

The recording medium having the toner image fused thereon is conveyed by the feed roller 25*b* and the sheet exit roller 25*c* to take a turn-over sheet exit route of the sheet conveying path S, and ejected on the sheet exit tray 15 as being turned over (i.e., the toner image facing down).

Second Embodiment

Figure 10:
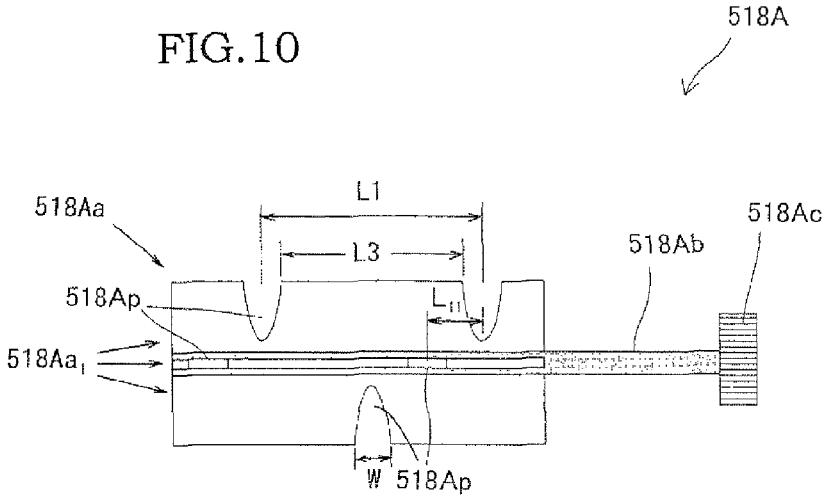
FIG. 10 is a perspective view showing a first developer conveying helical member of a developing device according to a second embodiment of the present invention.

FIG. 10 is a perspective view showing a first developer conveying helical member (first helical member) in a developing device according to a second embodiment of the present invention.

Because the second embodiment is the same as the first embodiment except for a first developer scooping member 518A and a not-shown second developer scooping member, a description will be given hereinafter mainly of the difference from the first embodiment with reference to FIG. 10.

Because the second developer scooping member is similarly structured as the first developer scooping member 518A, the description thereof will not be repeated herein.

The first developer scooping member 518A is structured with a third rotary shaft 518Ab and a third gear 518Ac which are similar to the third rotary shaft 118Ab and the third gear 118Ac of the first developer scooping member 118A (see FIG. 7) according to the first embodiment, and a first scooping blade 518A which differs from the first scooping blade 118Aa according to the first embodiment.

The first scooping blade 518Aa is made up of four first scooping plate portions 518$Aa_1$ fixed to the outer circumferential surface of the third rotary shaft 518Ab, each forming a central angle of 90° between adjacent one of the first scooping plate portions 518$Aa_1$.

The first scooping plate portions 518$Aa_1$ each extend in the axial direction of the third rotary shaft 518Ab, and provided with a plurality of notches 518Ap for avoiding any contact with the helical blade 112*a* when the first rotary shaft 112*b* of the first helical member 112 (see FIG. 5) and the second rotary shaft 518Ab synchronously rotate.

The notch 518Ap may be rectangular-shaped, U-shaped, or V-shaped, for example. In consideration of maximizing a contact area with the developer so as to improve the scooping efficiency, the U-shape or the V-shaped is preferable.

In one first scooping plate portion 518$Aa_1$, an interval L1 between two adjacent ones of the notches 518Ap is just as great as the helical interval L2 (see FIG. 4) of the helical blade 112*a* of the first helical member 112, while a length L3 of an edge portion between the two adjacent notches 518Ap is set shorter than the helical interval L2.

In order to avoid any contact with the helical blade 112*a* of the first helical member 112 that synchronously rotate, two adjacent ones of the first scooping plate portions 518$Aa_1$ adjacent to each other by the central angle of 90° are disposed on the third rotary shaft 518Ab such that an interval $L_{11}$ which is an axial displacement amount of the notches 518Ap of the two adjacent first scooping plate portions 518$Aa_1$ becomes one-fourth as short as the interval L1.

It goes without saying that a width W of each notch 518Ap and the length L3 are set so as to avoid any contact between the first scooping plate portion 518$Aa_1$ and the rotating helical blade 112*a* of the first helical member 112.

As in the first embodiment, in the second embodiment also, because the first developer scooping member 518A rotates in synchronization with the first helical member 112 at the same rotation speed, the developer around the first rotary shaft 112*b* can be scooped out and sent into the second developer conveying passage Q while avoiding any contact with the helical blade 112*a*.

It is to be noted that the rotation speed of the first developer scooping member 518Aa may be faster or slower than that of the first helical member 112. In such cases, in order to avoid any contact between the first developer scooping member 518Aa and the first helical member 112, the interval $L_{11}$ and the width W of each of the notches 518Ap of the first scooping plate portions 518$Aa_1$ should be adjusted in accordance with a ratio between the rotation speed of the first developer scooping member 518Aa and that of the first helical member 112.

The same holds true for the second developer scooping member.

Third Embodiment

Figure 11:
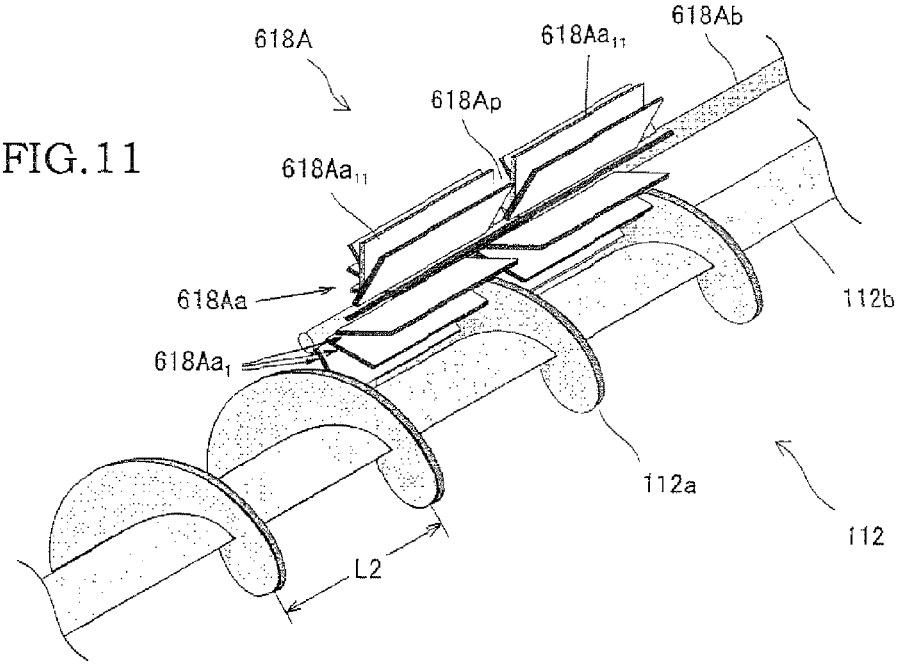
FIG. 11 is a perspective view showing a first developer conveying helical member of a developing device according to a third embodiment of the present invention.

FIG. 11 is a perspective view showing a first developer conveying helical member (first helical member) of a developing device according to a third embodiment of the present invention.

Because the third embodiment is the same as the first embodiment except for a first developer scooping member 618A and a not-shown second developer scooping member, a description will be given hereinafter mainly of the difference from the first embodiment with reference to FIG. 11.

Because the second developer scooping member is similarly structured as the first developer scooping member 618A, the description thereof will not be repeated herein.

The first developer scooping member 618A is structured with a third rotary shaft 618Ab and a third gear (not shown) which are similar to the third rotary shaft 118Ab and the third gear 118Ac of the first developer scooping member 118A (see FIG. 7) according to the first embodiment, and a first scooping blade 618Aa which differs from the first scooping blade 118Aa according to the first embodiment.

The first scooping blade 618Aa is made up of twelve first scooping plate portion sets 618$Aa_1$ radially disposed about the third rotary shaft 618Ab, each forming a central angle of 30° between adjacent one of the first scooping plate portion sets 618$Aa_1$.

The first scooping plate portion sets 618$Aa_1$ extend in the axial direction of the third rotary shaft 618Ab having intervals being clearances 618Ap for avoiding any contact with the helical blade 112*a* when the first and third rotary shafts 112*b* and 618Ab synchronously rotate.

In more detail, the four first scooping plate portion sets 118$Aa_1$ of the first developer scooping member 118A according to the first embodiment shown in FIG. 7 have their opposite ends in terms of the longitudinal direction aligned on the third rotary shaft 118Ab. Each of the first scooping plate portion sets 118$Aa_1$ has one or two clearance(s) 118Ap, and is structured with two or three plate pieces 118$Aa_{11}$ which differ from one another in length.

On the other hand, the twelve first scooping plate portion sets 618$Aa_1$ of the first developer scooping member 618A according to the third embodiment shown in FIG. 11 have their opposite ends in terms of the longitudinal direction displaced from one another on the third rotary shaft 618Ab. Each set of the first scooping plate portion sets 618$Aa_1$ has one clearance 618Ap, and is structured with two plate pieces 618$Aa_{11}$ which are identical to each other in length.

In other words, the first developer scooping member 618A of the third embodiment is disposed such that the plurality of plate pieces 618$Aa_{11}$ each form a central angle of 30° between adjacent one of the plate pieces 618$Aa_{11}$, and such that the clearances 618Ap are disposed on the third rotary shaft 618Ab in a helical manner reversely to the helical twist direction of the first helical blade 112*a*.

That is, two adjacent ones of the first scooping plate portion sets 618$Aa_1$ adjacent to each other by the central angle 30° are disposed on the third rotary shaft 118Ab such that an interval (displacement dimension) L11 (see FIG. 7) which is an axial displacement of the clearances 618Ap of the two adjacent first scooping plate portion sets 618$Aa_1$ becomes one-twelfth as short as the helical interval L2.

It goes without saying that a width W of each clearance 618Ap and the length of each plate piece 618$Aa_{11}$ are set so as to avoid any contact between the first scooping plate portion 618Aa$_1$ and the rotating helical blade 112*a*.

As in the first embodiment, in the third embodiment also, because the first developer scooping member 618A rotates in synchronization with the first helical member 112 at the same rotation speed, the developer around the first rotary shaft 112*b* can be scooped out and sent into the second developer conveying passage Q while avoiding any contact with the helical blade 112*a*.

The same holds true for the second developer scooping member.

What is claimed is:

1. A developing device to be installed in an electrophotographic image forming apparatus including a photoconductor drum that is to have an electrostatic latent image formed on a surface thereof, the developing device comprising:

a developer vessel that accommodates a developer containing a toner and a carrier;

a toner supply port for supplying the toner into the developer vessel;

a developing roller that is disposed in the developer vessel and that rotates while carrying the developer to supply the toner onto the surface of the photoconductor drum having the electrostatic latent image formed thereon;

a developer conveying passage that is disposed between a position in the developer vessel where the toner is supplied and the developing roller; and a developer conveying helical member and a developer scooping member that are rotatably disposed in the developer conveying passage to convey the developer in the developer conveying passage to the developing roller while agitating the developer, wherein the developer conveying passage includes: a first developer conveying passage associated with the toner supply port and a second developer conveying passage associated with the developing roller, the first developer conveying passage and the second developer conveying passage being defined by a partitioning plate extending in parallel to an axial direction of the developing roller; and a first communicating path and a second communicating path that establish a communication between the first developer conveying passage and the second developer conveying passage at opposite sides in the axial direction, the developer conveying helical member includes a first developer conveying helical member disposed in the first developer conveying passage and a second developer conveying helical member disposed in the second developer conveying passage, the first developer conveying helical member includes a first rotary shaft rotatably disposed in the first developer conveying passage and a first helical blade fixed to the first rotary shaft, the second developer conveying helical member includes a second rotary shaft rotatably disposed in the second developer conveying passage and a second helical blade fixed to the second rotary shaft, the developer scooping member includes a first developer scooping member disposed near the first communicating path to send the developer in the first developer conveying passage into the second developer conveying passage, and a second developer scooping member disposed near the second communicating path to send the developer in the second developer conveying passage into the first developer conveying passage, the first developer scooping member includes a third rotary shaft rotatably disposed in the first developer conveying passage and near the first communicating path and a first scooping blade fixed to the third rotary shaft so as to avoid any contact with the first and second helical blades, and the second developer scooping member includes a fourth rotary shaft rotatably disposed in the second developer conveying passage and near the second communicating path and a second scooping blade fixed to the fourth rotary shaft so as to avoid any contact with the first and second helical blades, and the first developer conveying helical member and the second developer conveying helical member convey the developer in directions opposite to each other and the first developer scooping member and the second developer scooping member convey the developer in directions opposite to each other, such that the developer circulates through the first developer conveying passage and the second developer conveying passage.

2. The developing device according to claim 1, further comprising:

a first rotary mechanism that synchronously rotates the first rotary shaft and the third rotary shaft, and a second rotary mechanism that synchronously rotates the second rotary shaft and the fourth rotary shaft, wherein the first scooping blade is made up of a plurality of first scooping plate portions radially disposed about the third rotary shaft, the second scooping blade is made up of a plurality of second scooping plate portions radially disposed about the fourth rotary shaft, the first scooping plate portions are formed so as to extend in an axial direction of the third rotary shaft and have a plurality of clearances or notches for avoiding any contact with the first helical blade when the first and third rotary shafts are synchronously rotated, and the second scooping plate portions are formed so as to extend in an axial direction of the fourth rotary shaft and have a plurality of clearances or notches for avoiding any contact with the second helical blade when the second and fourth rotary shafts are synchronously rotated.

3. The developing device according to claim 2, wherein the first rotary mechanism rotates the first rotary shaft and the third rotary shaft at an identical rotation speed, and the second rotary mechanism rotates the second rotary shaft and the fourth rotary shaft at an identical rotation speed, and an interval of the plurality of clearances or notches of the first scooping plate portions is identical to a helical interval of the first helical blade, and an interval of the plurality of clearances or notches of the second scooping plate portions is identical to a helical interval of the second helical blade.

4. The developing device according to claim 2, wherein a central angle formed between two circumferentially adjacent ones of the first scooping plate portions and a central angle formed between two circumferentially adjacent ones of the second scooping plate portions are each 30 to 90.degree.

5. The developing device according to claim 1, wherein the third rotary shaft of the first developer scooping member is rotated such that a part of the first scooping blade in a downward position relative to the third rotary shaft shifts in a direction identical to a shifting direction of the developer shifting from the first developer conveying passage to the second developer conveying passage, and the fourth rotary shaft of the second developer scooping member is rotated such that a part of the second scooping blade in a downward position relative to the fourth rotary shaft shifts in a direction identical to a shifting direction of the developer shifting from the second developer conveying passage to the first developer conveying passage.

6. An image forming apparatus, comprising:

a photoconductor drum that is to have an electrostatic latent image formed on a surface thereof;

a charging device that electrifies the surface of the photoconductor drum;

an exposure device that forms the electrostatic latent image on the surface of the photoconductor drum;

the developing device according to claim 1 which supplies a toner to the electrostatic latent image on the surface of the photoconductor drum to form a toner image;

a toner supplying device that supplies the toner to the developing device;

a transferring device that transfers the toner image on the surface of the photoconductor drum to a recording medium; and a fusing device that fuses the toner image on the recording medium.

* * * * *